US006450187B1

(12) United States Patent
Lin et al.

(10) Patent No.: US 6,450,187 B1
(45) Date of Patent: Sep. 17, 2002

(54) REINFORCED SUPPORT MEMBER AND METHOD

(75) Inventors: Tseng Hsiang Lin, Kuala Lumpur (MY); Craig B. Adams, Portland, OR (US)

(73) Assignee: YJ (USA), Portland, OR (US)

( * ) Notice: Subject to any disclaimer, the term of this patent is extended or adjusted under 35 U.S.C. 154(b) by 0 days.

(21) Appl. No.: 09/503,136

(22) Filed: Feb. 11, 2000

Related U.S. Application Data

(60) Provisional application No. 60/120,716, filed on Feb. 16, 1999.

(51) Int. Cl.[7] ..... E04H 15/60

(52) U.S. Cl. ..... 135/114; 135/124; 135/127; 428/376; 428/392

(58) Field of Search ..... 135/114, 127, 135/124; 428/376, 392

(56) References Cited

U.S. PATENT DOCUMENTS 4,172,175 A 10/1979 Pearson et al.
4,664,472 A * 5/1987 Mayr ..... 428/376
4,877,044 A * 10/1989 Cantwell ..... 135/114
5,038,812 A 8/1991 Norman
5,301,705 A 4/1994 Zheng
5,356,709 A * 10/1994 Woo ..... 428/376
5,467,794 A 11/1995 Zheng
5,468,531 A * 11/1995 Kikukawa ..... 428/36.5
5,579,799 A 12/1996 Zheng
5,590,674 A * 1/1997 Eppenbach ..... 135/114
5,676,168 A 10/1997 Price
5,902,656 A * 5/1999 Hwang ..... 428/36.91
5,921,870 A * 7/1999 Chaisson ..... 472/317
6,148,866 A * 11/2000 Quigley ..... 174/47
6,213,672 B1 * 4/2001 Varga ..... 403/109.2

* cited by examiner

*Primary Examiner*—Beth A. Stephan
(74) *Attorney, Agent, or Firm*—Ipsolon, LLP

(57) ABSTRACT

A support structure for use primarily as a lightweight, portable, strong, and fracture resistant tent support and the like, and method for making thereof. The support structure includes a fiberglass core and a resilient outer layer of material that is at least 0.2 millimeters thick. Preferably, the outer layer is made of polyethylene that is between 0.5 to 0.6 millimeters thick, inclusive. In a preferred embodiment, the support structure is curved to conform with the shape of the tent it supports, thereby preventing the support structure from springing back when inadvertently released from the tent. More preferably, the support member includes a plurality of elongate curved sections that are detachably secured together to form the support member.

17 Claims, 2 Drawing Sheets

REINFORCED SUPPORT MEMBER AND METHOD

This application claims the benefit of U.S. Provisional Application No. 60/120,716 filed on Feb. 16, 1999, and Australian Provisional Application No. PQ2112 filed on Aug. 9, 1999.

TECHNICAL FIELD

The invention is an improved support member for use primarily as a lightweight, portable, strong, and fracture resistant tent support and the like, and method for making thereof.

BACKGROUND OF THE INVENTION

There is a need for lightweight, portable, strong, and fracture resistant support structures. For example, it is desirable for tents to be as lightweight, easy to assemble and disassemble, and compact as possible when collapsed. Accordingly, the support structure must be equally portable, and lightweight, but sufficiently strong to support the tent when assembled.

Moreover, tents are now used for a wide variety of functions. For example, in addition to the typical hiking and camping functions, tents, which may be readily shaped and decorated to resemble playhouses, sports accessories, or vehicles, are now commonly used as children's toys. Accordingly, their support structures must be particularly safe to assemble, disassemble, and use.

As shown in FIG. 1, the typical tent support structure 10 includes a plurality of hollow elongate straight sections 12, constructed typically of elongate strands of fiberglass secured and hardened together with an appropriate resin. The sections 12 each include mating end portions 14 that interconnect with each other to allow the sections 12 to be detachable secured together to form the elongate straight support structure 10. An elongate elastic element 15 may extend through the hollow core securing the sections 12 together. Known tent support structures are secured within pockets or loops 18 attached to the tent 16. The structures are then bent and held in place such that they are placed in tension, thereby supporting the tent 16.

Another form of portable tent support includes interfitting sections of metal tubular poles, such as aluminum, end-to-end. Each such section includes a mating end portion for detachably securing it with an adjacent end of another section, thereby producing the extended pole.

While these types of conventional support members are economical to manufacture, lightweight, and easy to assemble and disassemble, they have several limitations that affect their desirability, particularly when used in tents for children's use. For example, when excessive bending force is applied to these known fiberglass supports, such as by a child falling on or throwing a heavy object onto the tent, as best shown in FIG. 2 the strands of fiberglass tend to splinter exposing shrouds 19 of fiberglass and causing an extreme safety hazard. On the other hand, known metal supports tend to bend permanently when excessive force is applied, rendering them useless.

Moreover, because the typical fiberglass support is under tension during use, known fiberglass supports have a tendency to spring back into their straight positions when the tent fails or the support is moved out of its secured position within the tent, such as when a child inadvertently plays with the support structure. The spring back motion poses a safety risk to the user, particularly to small children playing within a toy tent.

Inventors have attempted to overcome these problems by attempting to make fiberglass support structures stronger. For example, U.S. Pat. No. 4,172,175 to Pearson et al. ("Pearson") discloses a fiberglass pole construction method that includes placing layers of elongate fiberglass strands in alternating directions to produce a strong hollow pole. The strands of fiberglass are held in place during manufacturing by "thin lateral bands 56" (See, FIG. 5 of Pearson). The bands are constructed with "a fused polymeric material such as polyethylene which has a lower melting point than the glass fibers." (Pearson, col. 3, lines 48–50). The bands serve to hold the fiberglass strands aligned during the manufacturing process. The fiberglass resin is then heated during the curing process, and the bands melt away while the resin hardens.

The resulting alternating layers of orthogonally aligned fiberglass fibers in Pearson provide an essentially rigid and strong pole. However, it is not well suited for use as a tent support for at least the following reasons: First, the pole is not particularly flexible along its longitudinal length making it difficult at best to place the pole in tension to support the tent. Second, when an inadvertent breaking force is applied to the pole, shrouds of fiberglass are still exposed, causing a significant safety risk, particularly to young children. And third, it is expensive to build.

Accordingly, despite these types of improvements, there remains a need for a support structure that is strong, portable, and economical to manufacture, but also is fracture resistant and safe to assemble and use. In addition to other benefits that will become apparent in the following disclosure, the present invention fulfills these needs.

SUMMARY OF THE INVENTION

The present invention is a support structure that includes a fiberglass reinforced core portion and an elastic outer layer, which is preferably polyethylene, and a method for making there same. More preferably, the support structure may include a plurality of elongate curved sections having a hollow core, and the sections may be detachably secured together to define an assembled position and form the support member having the shape of the structure or tent they are meant to support. An elongate resilient element may extend through the hollow core securing the sections together and urging them to retain their assembled position.

DETAILED DESCRIPTION OF THE INVENTION

Figure 1:
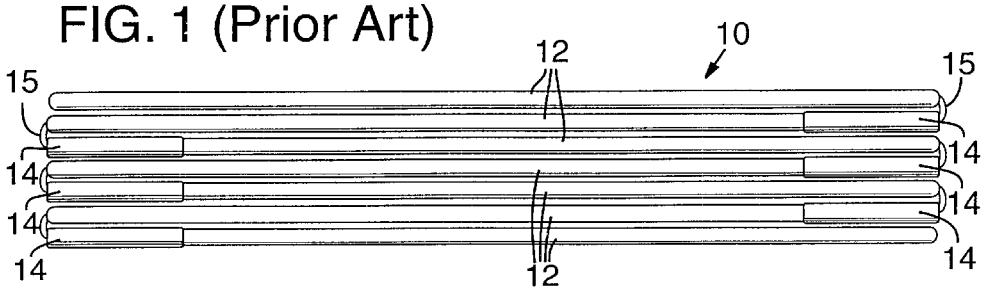
FIG. 1 (Prior Art)
FIG. 1 (Prior Art) is a top plan view of a conventional fiberglass support structure in its disassembled configuration.
Figure 2:
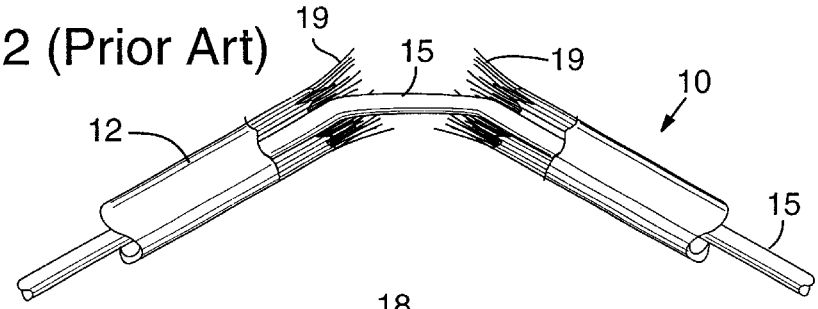
FIG. 2 (Prior Art)
FIG. 2 (Prior Art) is a fragmentary exploded plan view of a conventional fiberglass support showing a possible fracture.
Figure 3:
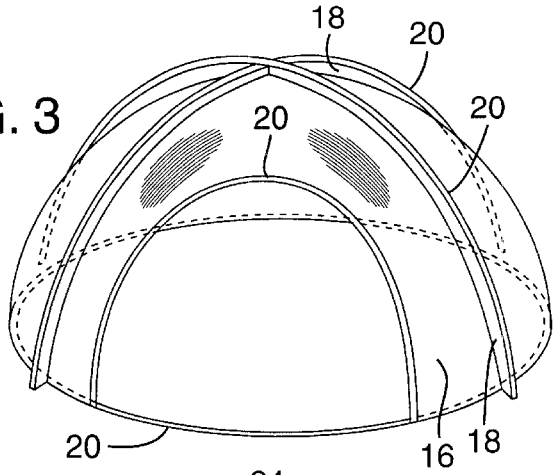
FIG. 3 is an isometric view of a tent having support members in accordance with a preferred embodiment of-the invention.

An elongate improved support member 20 having a fiberglass core 22 with an outer surface (23, FIG. 8) and a durable outer layer 24 of elastic material, preferably constructed of polyethylene and having a smooth exterior surface 26 is disclosed in FIGS. 3–8.

General Assembly

Figure 4:
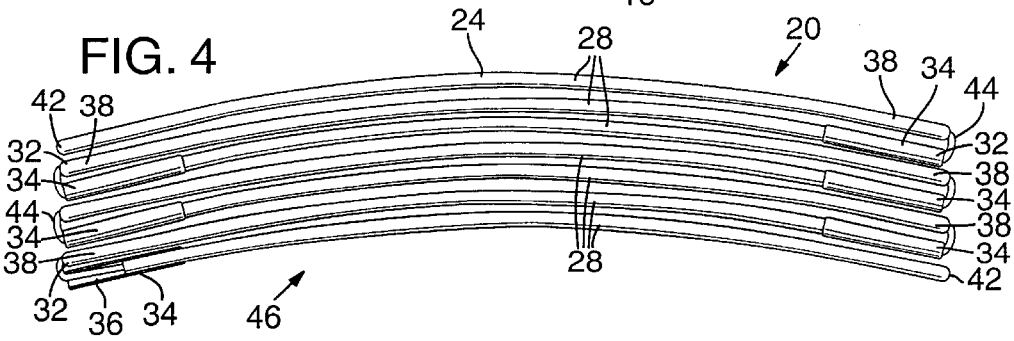
FIG. 4 is a top plan view of a support member in accordance with a preferred embodiment of the present invention showing a possible disassembled configuration.
Figure 5:
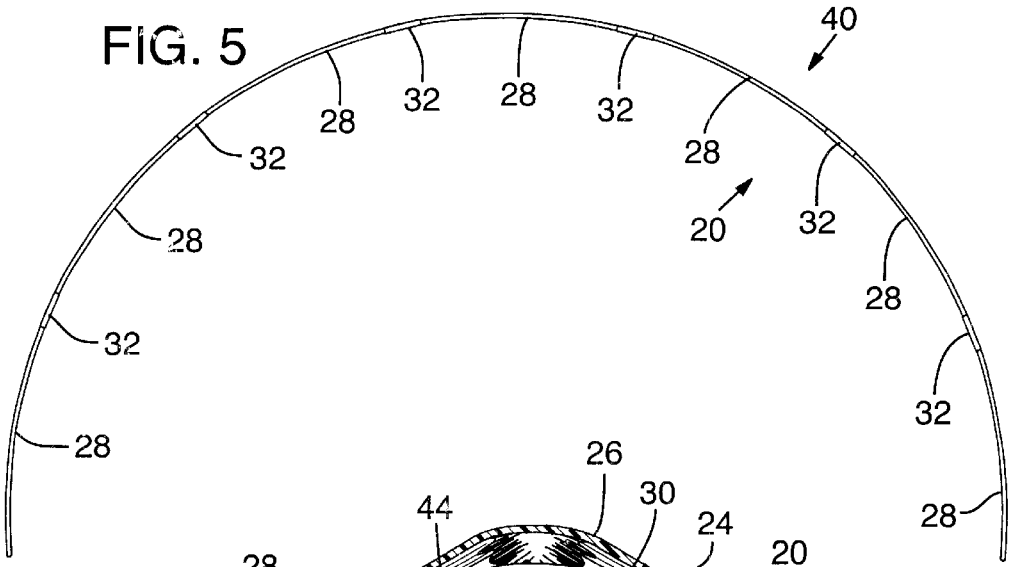
FIG. 5 is a side plan view of the support member of FIG. 4 showing a possible assembled position.
Figure 8:
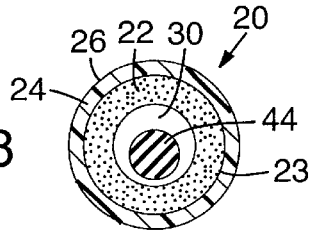
FIG. 8 is a cross sectional view of the support member of FIG. 7 taken along line 8—8 of FIG. 7.

As best shown in FIGS. 4, 5 & 8, the support member 20 preferably includes a plurality of discrete sections 28. Each section 28 includes a hollow center 30, the fiberglass core 22 and the outer layer 24 of elastic material, which is preferably polyethylene at least 0.02 millimeters thick.

Preferably, each section 28 includes mating end portions 32 for detachably securing the discrete sections 28 together. In particular, the end portions 32 are rigidly secured to one end 34 of each discrete section 28 and have a section retention portion 36 for detachably receiving the free end 38 of another discrete section 28. Accordingly, as best shown in FIG. 5, the discrete sections 28 may be detachable secured together end-to-end to form the elongate support member 20 defining an assembled position 40. End caps 42 are secured within the open ends of the support member 20.

More preferably, the discrete sections 28 are curved, and an elongate resilient element 44 extends through the hollow center 30 of each discrete section 28 securing the discrete sections 28 together and urging them to retain the support in its assembled position 40.

Preferred Construction Method

The elongate fiberglass core 22 of the discrete sections 28 is preferably constructed with traditional methods such as by extruding a continuous length of fiberglass tubing and cutting the discrete sections 28 to length. The fiberglass core 22 preferably includes elongate strands of fiberglass secured within an appropriate resin. In situations where it is desirable for the discrete sections 28 to be curved, the extruding process must be modified to produce curved fiberglass core.

The outer layer 24 of resilient material is then installed on the fiberglass core. Preferably, the polymer outer layer 24 is a cylindrical section of polyethylene tubing having an inside diameter sized to just receive the fiberglass core 22 and a length slightly longer than the fiberglass core to ensure coverage of the fiberglass member.

In order to obtain meaningful strength and fracture improvements while retaining the elasticity of the support member in accordance with the objects of the present invention, the polyethylene outer layer 24 should be at least 0.2 millimeters thick. More preferably, the polyethylene outer layer 24 is between 0.2 to 1.0 millimeters thick, inclusive. Optimal performance is achieved when the polyethylene outer layer 24 is between 0.5 millimeters to 0.6 millimeters thick.

Preferably, the polyethylene is high density polyethylene, but desirable results can also be achieved with low density polyethylene. Similarly, materials having similar strength, elasticity, and formability characteristics to polyethylene, such as polyvinyl chloride ("PVC"), vinyl, polypropylene, polyurethane, rubber and latex can be used in place of polyethylene to produce the desirable results. However, polyethylene is the preferred material because of its low cost and ease of manufacturing, and it results in a support structure having optimal strength and elasticity characteristics.

After the fiberglass core 22 is placed within the polyethylene tubing, the assembly is passed through an appropriate heating device (not shown) to cause the polyethylene tubing to shrink into a tight fit over the fiberglass core 22 and to bond the polyethylene tubing onto the fiberglass core 22. To obtain maximum structural enhancement, the polyethylene should form a continuous layer around the fiberglass core. This could include complete inner and outer encapsulation of the fiberglass core 22 by the polyethylene.

The temperature to which the polyethylene tubing is heated is selected to cause the polyethylene to be heat welded to the fiberglass core 22, but below the temperature at which the polyethylene or the fiberglass deteriorates. The heating process also caused those portions of the polyethylene tubing overlapping the ends of the fiberglass core to shrink over the ends of the fiberglass core and heat welded thereto.

After the polyethylene outer layer 24 is bonded to the fiberglass core 22, the mating end portions 32 are secured to each discrete section 28 with conventional methods. Then, the elongate resilient element 44 is extended through the hollow center 30 of each discrete section 28 and secured in place, such as by inserting stop members (not shown) at each end of the support member 20. Finally, the end caps 42 are secured on the opposite ends of the support member 20.

Operation of the Support Member

A user assembles and uses the support member 20 much like a traditional fiberglass support member 10. From a compact position 46 shown in FIG. 4, the discrete sections 28 are aligned end-to-end and the free end 38 of each discrete section 28 is inserted into the section retention portion 36 of each adjacent discrete section 28, thereby placing the support member 20 in its assembled position 40 shown in FIG. 5. The support member 20 is then inserted in the sleeve or loops 18 of a tent (or flexible shell) 16, thereby supporting the tent 16.

In cases where the discrete sections 28 are straight, the resulting support member 20 operates like a conventional support. It is bent about two points, placing the support member 20 in tension and forming a curve that conforms to the shape of the tent. In such case, should the tent 16 rip or the support member 20 become dislodged, the support member 20 will attempt to spring-back into its straight position like a conventional support.

However, in cases where the discrete sections 28 are curved as shown in FIG. 4, they are preferably shaped such that when the support member 20 is in its assembled position 40, the support member 20 has a neutral shape that conforms with the shape of the tent 16 that it supports. In such case, the support member 20 is not essentially spring-loaded, and the risk of the support member 20 springing back should the tent rip or the support be inadvertently moved out of position is greatly reduced.

Testing also reveals that the addition of the polyethylene outer layer 24 to a fiberglass core 22 provides numerous benefits. For example, the polyethylene outer layer 24 has a smooth exterior surface 26 that reduces wear to the tent 16 without significantly increasing the cost of production. Also, testing indicates that the support member 20 retains its elasticity despite the presence of the polyethylene outer layer 24.

In addition, the support member 20 is much stronger than conventional fiberglass supports. In particular, a compression strength test was conducted comparing the strength between a control sample comprising a length of conventional 7 mm diameter fiberglass pole and a 7 mm diameter fiberglass pole having an polyethylene outer layer 24. The lengths of poles were each tested by extending them horizontally over two supports that were spaced 300 mm apart and securing them in place. A V-shaped block was placed on top of the poles and centered between the supports. An increasing compression force downward was then applied by the block to each pole until it fractured. The amount of force required to fracture each pole was then recorded. The control sample fractured when forces ranging between 26.38 kgf to 29.38 kgf were applied. In contrast, the fiberglass core having the polyethylene outer layer 24 fractured when forces ranging between 34.94 kgf to 36.54 kgf were applied, indicating it is roughly 40% stronger than the control sample.

Figure 6:
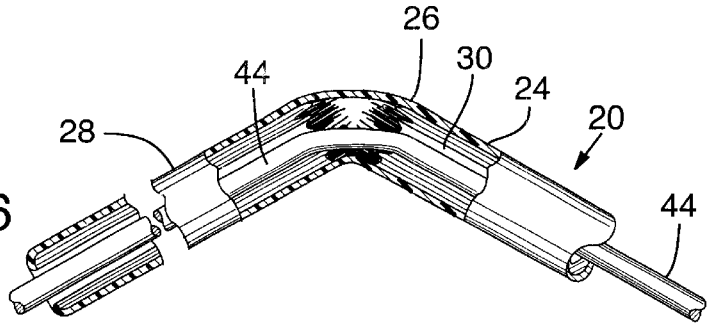
FIG. 6 is a fragmentary exploded plan view of a support member in accordance with a preferred embodiment of the present invention showing the initial stages of a possible fracture.
Figure 7:
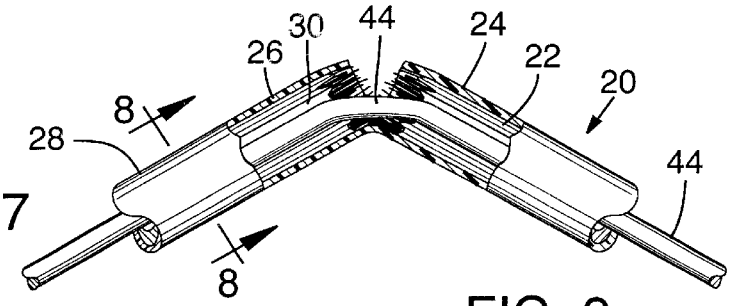
FIG. 7 is the support member of FIG. 3 showing the completed fracture.

Moreover, as best shown in FIGS. 6 & 7, when the support member 20 does fracture, the polyethylene outer layer 24 covers the resulting shrouds of fiberglass, preventing them from posing a safety hazard, and thereby further reducing the likelihood of injury.

In view of the wide variety of embodiments to which the principles of the invention can be applied, it should be apparent that the detailed description of the invention is illustrative only and should not be taken as limiting the scope of the invention. For example, the fiberglass core 22 could be constructed with any known means or methods, including molding, and the like. Moreover, the polyethylene outer layer 24 can be applied with a variety of methods including wrapping a sheet of polyethylene around the fiberglass core 22 and heat welding the overlapping polyethylene sheet to itself and onto the fiberglass core at the same time to form a seamless layer around the fiberglass core. It will also be appreciated that the polyethylene outer layer 24 may also be structurally bonded to the fiberglass core 22 using an adhesive or intermediate layer without departing from the scope of the invention.

Figure 9:
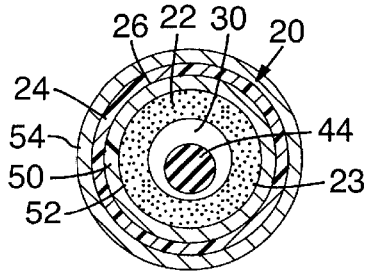
FIG. 9 is a cross sectional view of an alternative preferred support member in accordance with a preferred embodiment of the present invention.

To obtain the desired results, the elastic material only has to cover the fiberglass core. Accordingly, as shown in FIG. 9, an intermediate layer 50 of suitable material may be sandwiched between the outer surface 52 of the fiberglass core and the polyethylene without departing from the scope of the invention. Similarly, one or more layers of material 54 may be placed over the external surface 26 of polyethylene layer without departing form the scope of the invention.

Also, while the outer layer 24 is preferably constructed with polyethylene, other materials having similar physical properties may be substituted such as PVC, vinyl, polypropylene, polyurethane, rubber and latex.

Accordingly, the claimed invention includes all such modifications as may come within the scope of the following claims and equivalents thereto.

What is claimed is:

1. A tent assembly including:

a flexible shell having support sleeves;

a support structure having:

discrete sections of an elongate fiberglass core;

a layer of resilient material covering said fiberglass core and having a smooth external surface and selected from the group consisting of polyethylene, polyvinyl chloride, vinyl, polypropylene, polyurethane, rubber and latex; and means for detachably securing said discrete sections together to form the elongate support structure defining an assembled position of the support structure;

such that said support structure in its assembled position is inserted in said support sleeves of said shell to support said shell.

2. The elongate support for a tent of claim 1, wherein said resilient material is polyethylene having a thickness of 0.2 to 1.0 millimeters, inclusive, and said resilient material is heat welded to said discrete sections of said fiberglass core.

3. The elongate support for a tent of claim 1, wherein said resilient material is polyethylene and said resilient material is between 0.5 to 0.6 millimeters thick, inclusive.

4. A supported structure including:

a flexible structure having a support member engaging portion;

a support member operably secured to said support member engaging portion and supporting said flexible structure, said support member having, an elongate fiberglass core and an outer surface; and an elastic material covering said outer surface.

5. The support member of claim 4, wherein said elastic material is selected from the group consisting of polyethylene, polyvinyl chloride, vinyl, polypropylene, polyurethane, rubber and latex.

6. The supported structure of claim 4, wherein said elastic material is between 0.2 to 1.0 millimeters thick, inclusive.

7. The supported structure of claim 6, wherein said elastic material is between 0.5 to 0.6 millimeters thick, inclusive.

8. The supported structure of claim 4, wherein said elastic material is at least 0.2 millimeters thick.

9. The supported structure of claim 4, wherein said elastic material is polyethylene, and said fiberglass core is hollow.

10. The supported structure of claim 4, wherein said elastic material is adjacent to said outer surface of said fiberglass core.

11. The supported structure of claim 4, further including an intermediate layer between said fiberglass core and said elastic material.

12. The supported structure of claim 4, wherein said elastic material has an exterior surface and a layer of material is positioned adjacent to said exterior surface.

13. The supported structure of claim 4, wherein said fiberglass core is substantially straight.

14. The supported structure of claim 4, wherein said elongate fiberglass core is curved.

15. The supported structure of claim 4, wherein said support member is a tent support having a neutral shape that conforms with the shape of the tent.

16. The supported structure of claim 4, wherein said fiberglass core includes discrete sections detachably secured together.

17. The supported structure of claim 16, wherein said fiberglass core is hollow and a resilient element extends through the hollow, thereby securing said discrete sections together.

* * * * *